US007909686B2

(12) United States Patent
Achen

(10) Patent No.: US 7,909,686 B2
(45) Date of Patent: Mar. 22, 2011

(54) FLOOD AND COMBUSTION AIR VENT

(76) Inventor: John J. Achen, Yuma, AZ (US)

( * ) Notice: Subject to any disclaimer, the term of this patent is extended or adjusted under 35 U.S.C. 154(b) by 86 days.

(21) Appl. No.: 11/952,712

(22) Filed: Dec. 7, 2007

(65) Prior Publication Data

US 2009/0148236 A1 Jun. 11, 2009

(51) Int. Cl.
*F24F 13/08* (2006.01)

(52) U.S. Cl. ..... 454/283; 52/169.5; 454/277

(58) Field of Classification Search ..... 405/52; 454/48, 271, 273, 275, 276, 277, 254, 283; 52/169.5

See application file for complete search history.

(56) References Cited

U.S. PATENT DOCUMENTS

| | | | |
|---|---|---|---|
| 637,519 | A | 11/1899 | Mertins |
| 655,590 | A | 8/1900 | Thomas et al. |
| 2,790,376 | A | 4/1957 | Kennedy et al. |
| 2,930,309 | A | 3/1960 | Prager |
| 2,949,842 | A | 8/1960 | Crandall |
| 3,011,424 | A | 12/1961 | Kohnen |
| D201,933 | S | 8/1965 | Ruggles et al. |
| 3,791,280 | A | 2/1974 | Williamson |
| 4,469,018 | A | 9/1984 | Taulman |
| 4,550,648 | A | 11/1985 | Eagle |
| 4,592,271 | A | 6/1986 | Young |
| 4,676,145 | A | 6/1987 | Allred |
| 4,699,045 | A | 10/1987 | Hensley |
| 4,754,696 | A | 7/1988 | Sarazen et al. |
| 4,770,087 | A | 9/1988 | Danley |
| 4,821,628 | A | 4/1989 | Sarazen, Jr. et al. |
| 4,911,066 | A | 3/1990 | Carew |
| 5,120,273 | A | 6/1992 | Lin |
| 5,293,920 | A | 3/1994 | Vagedes |
| 5,349,799 | A | 9/1994 | Schiedegger et al. |
| 5,487,701 | A | 1/1996 | Schedegger et al. |
| 5,758,457 | A | 6/1998 | Achen |
| 5,950,384 | A | 9/1999 | Aarness |
| 5,967,691 | A | 10/1999 | Lancelot, III |
| 5,976,007 | A | 11/1999 | Powell et al. |
| 5,976,009 | A | 11/1999 | Achen |
| 6,012,260 | A | 1/2000 | Hendrick et al. |
| 6,052,959 | A | 4/2000 | LaBrosse |
| 6,113,488 | A | 9/2000 | Tiede |
| 6,431,980 | B1 | 8/2002 | Achen |
| 6,601,356 | B2 | 8/2003 | Snyder |
| 6,604,994 | B2 | 8/2003 | Achen |
| D492,401 | S | 6/2004 | Achen |
| 6,746,324 | B2 | 6/2004 | Achen |
| D493,880 | S | 8/2004 | Achen |
| D494,669 | S | 8/2004 | Achen |
| 6,875,102 | B2 | 4/2005 | Achen |
| D507,048 | S | 7/2005 | Achen |
| D521,630 | S | 5/2006 | Achen |

*Primary Examiner* — Tara Mayo-Pinnock

(74) *Attorney, Agent, or Firm* — The von Hellens Law Firm, Ltd.

(57) ABSTRACT

A flood and combustion air vent includes a louvered panel supporting a rodent screen for placement across an opening in a wall or door of an enclosed space in a building. The apertures in the louvered panel and rodent screen are sized to accommodate ingress and egress of flood water at a rate of water flow sufficient to prevent destructive hydrostatic forces from acting upon either the exterior or interior surfaces of the wall. Additionally, the rodent screen will prevent intrusion of rodents, vermin and reptiles into the enclosed space.

17 Claims, 8 Drawing Sheets

110

FLOOD AND COMBUSTION AIR VENT

BACKGROUND OF THE INVENTION

1. Field of the Invention

The present invention relates to residential buildings and, more particularly, to vents for use in garage walls, garage doors and building foundation walls for buildings and which satisfy federal and international regulations for flood vents and combustion air vents.

2. Description of Related Prior Art

Vents, in the form of louvered panels, have been used in doors, garage doors, garage walls and building walls for ventilation purposes. To prevent intrusion of insects and debris, fine mesh screens have been incorporated with the louvered panels. While these louvered panels and insect screens have met the requirements attendant ventilation of an adjacent enclosed space, it has become increasingly evident that they do not alleviate the pressure buildup due to hydrostatic forces that occur during flooding. A major cause relates to debris clogging the vents which prevents relatively unobstructed flow of water through the vent in either direction. During rising flood waters, the pressure buildup by the water on the exterior surface of a door or wall may be sufficient to collapse the door or wall as there is no equalizing pressure on the other side of the door or wall. As flood waters recede, the enclosure defined in part by a door(s) and walls may enclose a significant depth of water. If the flow of water out of the enclosure is not generally commensurate with the level of the receding flood water external thereto, internal pressures on the door/wall will exist. These flood water related pressures on the exterior and interior surfaces of doors and walls may be sufficient to cause collapse or destruction of the doors and/or walls and may cause the building, or a significant part of it to collapse. Thus, the building may be in effect destroyed rather than just damaged by short term presence of flood waters.

To alleviate flood water related problems and to establish requirements for providing sufficient air for gas fired water heaters and the like that may be present within an enclosed section of a building, numerous national and international regulations have been promulgated.

A national building code (BOCA) (§1210.2) requires ventilation of crawl spaces that provides cross ventilation on at least two approximately opposite sides having openings with a corrosion resistant mesh with not less than one quarter inch (6 mm.), nor more than one half inch (13 mm.) in any direction. The net area of each opening shall be not less than one square foot (0.093 $m^2$) for each 150 square feet (13.95 $m^2$) of foundation space. Additionally, BOCA has certain requirements for buildings and structures erected in areas prone to flooding. More particularly, fully enclosed spaces shall be designed to automatically equalize hydrostatic forces on exterior walls by allowing for entry and exit of flood water. To meet these requirements, there must be at least two openings having a total net area of not less than one square inch (645 $mm^2$) for every square foot (0.1 $m^2$) of enclosed area subject to flooding. The bottom of each opening shall not be higher than 12 inches (305 mm) above grade. The openings, whether equipped with screens, louvers, valves, or other coverings or devices, must permit the automatic entry and discharge of flood water.

The Federal Emergency Management Agency (FEMA) requires in §44 CFR 60.3 (C5) that all new construction and substantial improvements of fully enclosed areas below the lowest floor that are usable solely for parking of vehicles, building access or storage in an area other than a basement which are subject to flooding shall be designed to automatically equalize hydrostatic flood forces on exterior walls by allowing for entry and exit of flood waters. To meet these requirements, there must be a minimum of two openings having a total area not less than one square inch for every square foot of enclosed area subject to flooding. The bottom of all openings shall be no higher than one foot above grade. The openings may be equipped with screens, louvers, valves, or other coverings or devices provided that they permit the automatic entry and exit of flood waters.

The International Building Code (IBC) (P. 259-1202.3.1) requires that openings for under floor ventilation comply with the opening requirements of the American Society of Civil Engineers (ASCE) 24 and the International Mechanical Code (IMC) (Table 401.6). Air exhaust and intake openings that terminate outdoors shall be protected with corrosion resistant screens, louvers or grills having intake openings of not less than one quarter inch and not greater than one half inch. Additionally, for foundation wall ventilation openings, they must be made rodent proof by covering the openings with perforated sheet metal plates not less than 0.07 inches thick, expanded metal plates not less than 0.047 inches thick, cast-iron grills or grating, extruded aluminum load bearing vents or with hardware cloth of 0.035 inches wire or heavier. The openings therein shall not exceed one quarter inch.

The International Residential Code (IRC) has established certain flood resistant construction (P54 §R327). In essence, the requirements for an enclosed area below design flood elevation used solely for parking of vehicles, building access or storage and must include flood openings which meet certain criteria. There must be a minimum of two openings providing a total net area of at least one square inch per one square foot of enclosed area. The bottom of each opening shall be one foot above the adjacent ground level. Any louvers, screens or other opening covers shall allow the automatic flow of flood waters into and out of the enclosed areas. Any openings installed in doors or windows shall meet these requirements.

The American Society of Civil Engineers (ASCE) §ASCE 24-98 is directed to flood resistant design and construction. In essence, it requires that foundation openings allow automatic entry and exit of flood waters during design flood conditions. These openings shall meet the following requirements. There shall be a minimum of two openings on different sides of each enclosed area. The total net area of all openings shall be at least one square inch for each one square foot of enclosed area. The bottom of each opening shall be no more than one foot above the adjacent ground level. Any louvers, screens or other opening covers shall not block or impede the automatic flow of flood waters into and out of the enclosed areas. Furthermore, the difference between the exterior and interior flood water levels shall not exceed one foot during periods of maximum rate of rise and maximum rate of fall of flood waters and at any other times during the design, or lesser, flood events.

Additionally, the Federal Insurance Administration has issued requirements for buildings located in special flood hazard areas under the National Flood Insurance Program (NFIP). All new construction and substantial improvements with fully enclosed areas below the lowest floor that are usable for parking of vehicles, building access or storage in an area other than a basement and which are subject to flooding shall be designed to automatically equalize hydrostatic flood forces on exterior walls by allowing for entry and exit of flood waters. These requirements include a minimum of two openings having a total area of not less than one square inch for every square foot of enclosed area subject to flooding. The bottom of all openings shall be no higher than one foot above grade. The openings may be equipped with screens, louvers, valves or other coverings or devices provided that they permit the automatic entry and exit of flood waters. For buildings with attached garages, the openings are required in either the exterior walls of the garage or in the garage doors themselves. It is anticipated that a large amount of debris will be associated with flooding and the fact that the openings include some form of vermin (rodent) screen to meet the applicable building codes, there is a high probability that at least one opening may be obstructed during a flood. For this reason, openings are required in at least two different sides of the enclosed area, and must be incorporated in the calculations.

SUMMARY OF THE INVENTION

A louvered panel includes a plurality of louvers defining a width of no more than one quarter inch and the length may vary as a function of various factors. A rodent screen is located adjacent the interior surface of the louvered panel to prevent intrusion of rodents, snakes and other vermin that may be present during flooding. The rodent screen includes a plurality of openings generally corresponding in location with adjacent louvers sized no less than one quarter inch in one dimension and one half inch in another dimension. Non-rectangular configurations may, in the alternative, be configured in the rodent screen that meet the size restrictions of various applicable codes. These vents may be installed in garage doors, garage walls, foundation walls, and/or doors leading to flood water affected areas.

It is therefore a primary object of the present invention to provide a vent which meets code requirements attendant impact of flood waters.

Another object of the present invention is to provide a flood vent that includes a rodent screen to prevent intrusion of rodents and reptiles while accommodating a flow of flood water in either direction.

Still another object of the present invention is to provide a combustion air vent capable of meeting the air flow requirements within an enclosed space housing a gas-fired water heater, or other device having a flame.

A further object of the present invention is to provide a flood water and combustion air event that equalizes hydrostatic pressures on opposed sides during flooding and that provides sufficient ventilation to meet combustion air requirements.

A still further object of the present invention is to provide a method for preventing hydrostatic pressure buildup on a wall of a building during flooding.

A yet further object of the present invention is to provide a method for satisfying flood and combustion air requirements with a vent.

A yet further object of the present invention is to provide a flood and combustion air vent that may be used in new construction or as a retrofit in existing buildings.

These and other objects of the present invention will become apparent to those skilled in the art as the description thereof proceeds.

BRIEF DESCRIPTION OF THE DRAWINGS

The present invention will be described with greater specificity and clarity with reference to the following drawings in which.

DESCRIPTION OF THE PREFERRED EMBODIMENT

Figure 1:
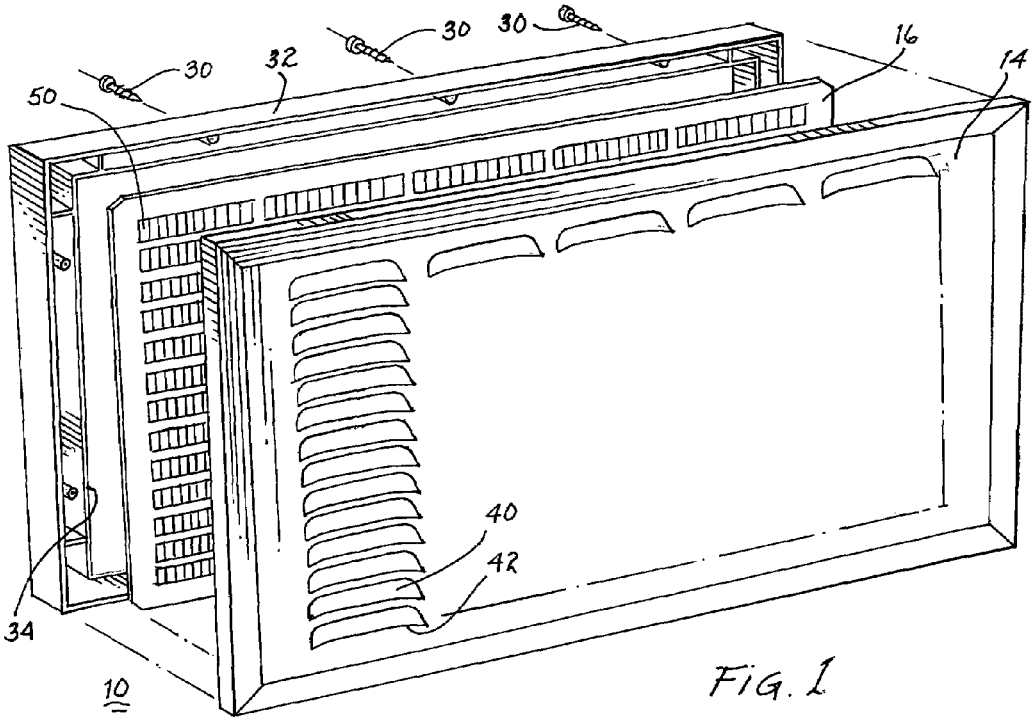
FIG. 1 is an exploded view of the elements of a flood and combustion air vent particularly adapted for use in a panel of a garage door.
Figure 2:
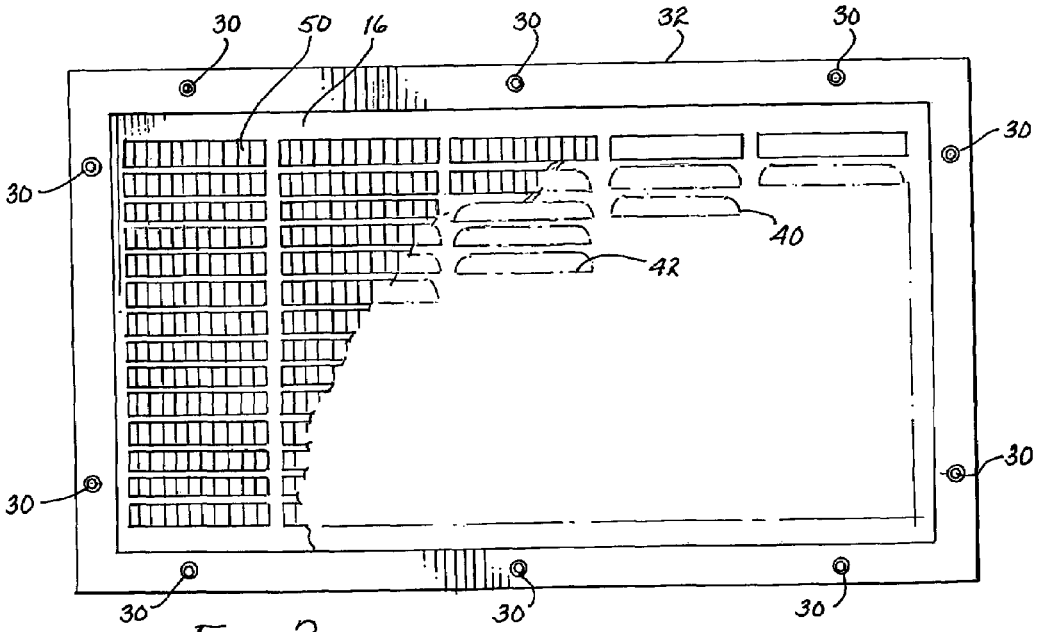
FIG. 2 is a rear view of the vent shown in FIG. 1.
Figure 3:
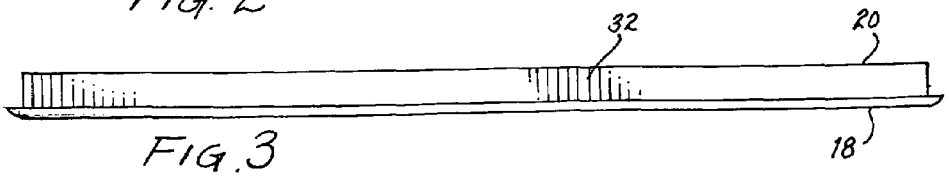
FIG. 3 is a top view of the vent shown in FIG. 2.
Figure 4:
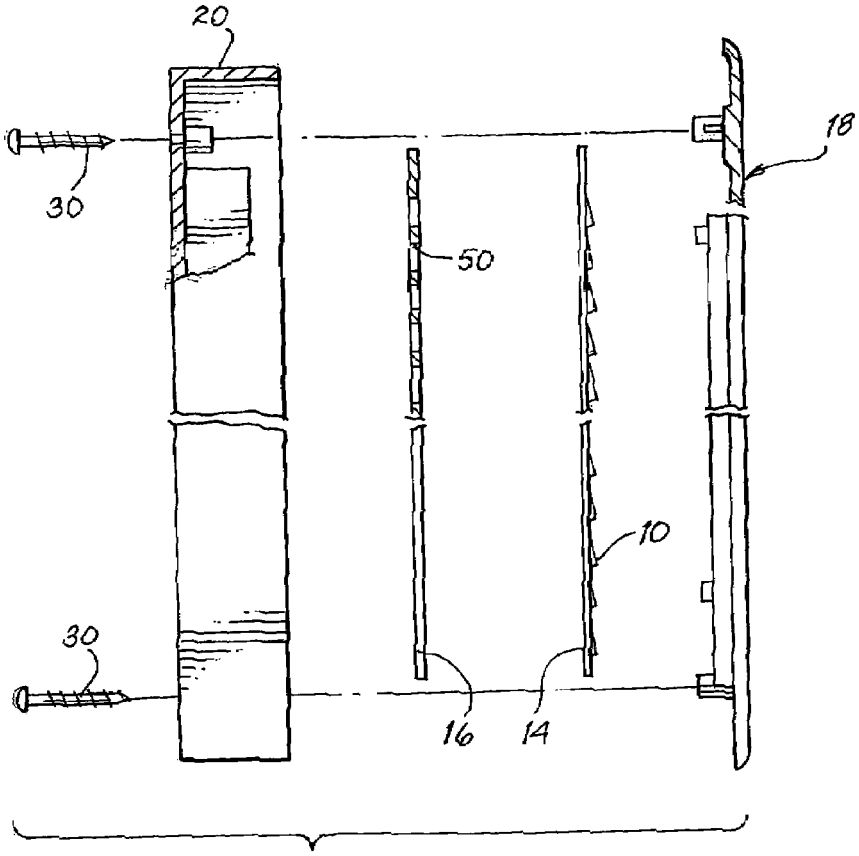
FIG. 4 is an exploded side view of the vent shown in FIG. 1.
Figure 6:
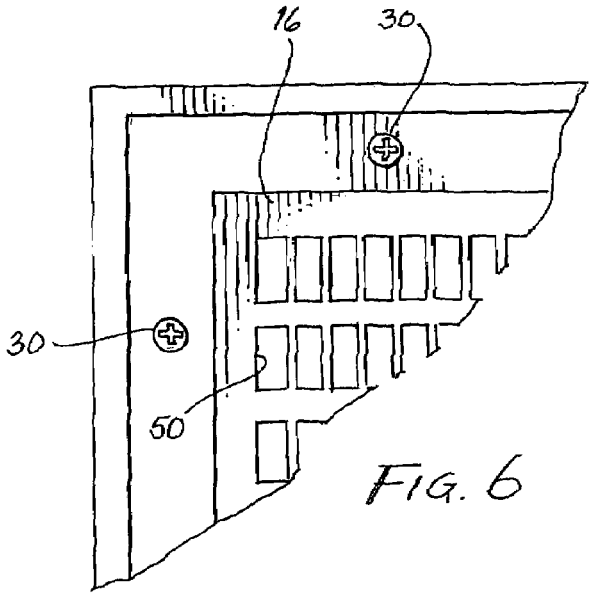
FIG. 6 is a partial rear view of the vent shown in FIG. 1.
Figure 5:
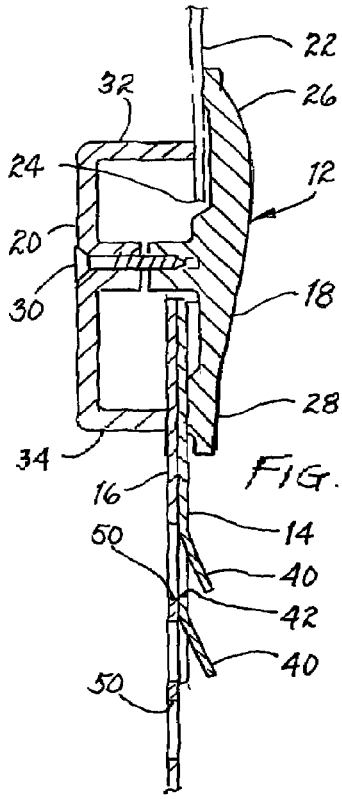
FIG. 5 is a partial cross-sectional view illustrating the two part frame, louvered panel and rodent screen shown in FIG. 1.

Referring to FIG. 1, there is illustrated a flood and combustion air vent 10 particularly suited for installation in a panel of a retractable garage door. A detailed description of this vent will be in reference to FIGS. 1-6. The frame 12 (see FIG. 5) for the vent may be a commercially available frame or may be specially configured to support louvered panel 14 and rodent screen 16. Frame 12 includes a fascia 18 and a backing 20. As particularly shown in FIG. 5, a panel 22 of a garage door includes an opening defined in part by edge 24 in the panel. The fascia includes an extension 26 which extends laterally from edge 24 and bears against panel 22, as illustrated. Thereby, the fascia circumscribes edge 24. A further lateral extension 28 of the fascia extends inwardly from edge 24 into the area of the opening defined by the edge to support louvered panel 14 and rodent screen 16 within the opening. Backing 20 is in the nature of a rectangular element secured to fascia 18 by a plurality of attachment means, such as screws 30 illustrated; bolts, or the like may also be used. The backing includes a side 32 bearing against the inside surface of panel 22 of the garage door. The combination of side 32 and extension 26 bearing against opposite sides of panel 22 secures frame 12 within the panel of the garage door. A further side 34 of backing 20 extends toward extension 28 of fascia 18 to clamp louvered panel 14 and rodent screen 16 therebetween upon tightening of screw(s) 30.

Louvered panel 14 includes a plurality of louvers 40 in conformance with national and international requirements for flood vents. Opening 42 (see FIG. 5) has a width of at least one quarter inch. As there is no restriction on the length of the opening, it may be of any length commensurate with the configuration of the louvered panel. Thereby, water as well as air, will flow relatively unimpeded through the louvers and small debris will not cause clogging of the openings of the louvers.

As has been learned many times during flooding, rodents, vermin and reptiles either deliberately enter or are washed into buildings through openings. These rodents, vermin and reptiles are potentially dangerous to occupants of a building and may be dangerous to safety and construction personnel that may enter the building during and after a flood event. Furthermore, many of these rodents, vermin and reptiles die or are otherwise injured, which creates a significant health hazard from the putrefying flesh.

To prevent entry of rodents, vermin and reptiles during flooding and otherwise, a rodent screen 16 is embodied in vent 10. This rodent screen must serve two purposes. First, it must permit sufficient rate of water flow therethrough to prevent hydrostatic forces on the inside or outside of a wall or garage door from becoming excessive and out of compliance with applicable building codes. Second, the rodent screen must have sufficiently small apertures to preclude entry of rodents, vermin and reptiles. It is to be understood that as the first requirement attendant flood waters is met, the requirement for flow of air to meet combustion air requirements is inherently met.

Figure 7A:
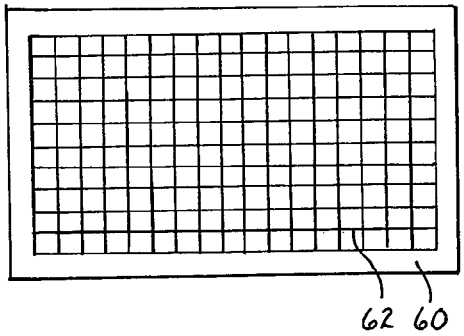
FIG. 7*a* illustrates a variation of the rodent screen shown in FIG. 7.
Figure 7B:
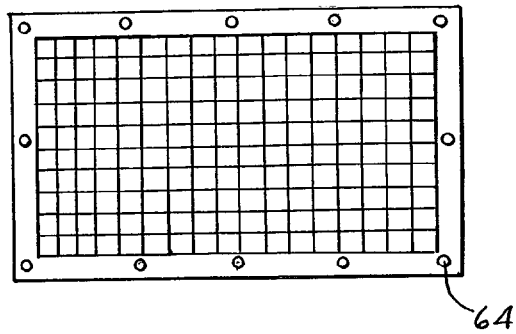
FIG. 7*b* illustrates a rear view of the rodent screen shown in FIG. 7*a;*

To meet flood water requirements, rodent screen 16 includes a plurality of apertures 50 formed therein and generally juxtaposed with the louvers in louvered panel 14. Each of these apertures may be rectangular as illustrated. To meet code requirements, these apertures have one dimension no less than a quarter inch and second dimension no greater than a half inch. As illustrated in FIGS. 1, 2, 6 and 7, the horizontal dimension of the rectangular apertures is no less than a quarter inch and the vertical dimension is no greater than a half inch. FIGS. 7*a* and 7*b* illustrate a rodent screen 60 wherein each of apertures 62 is no less than one quarter inch square, nor more than one half inch square.

Figure 7:
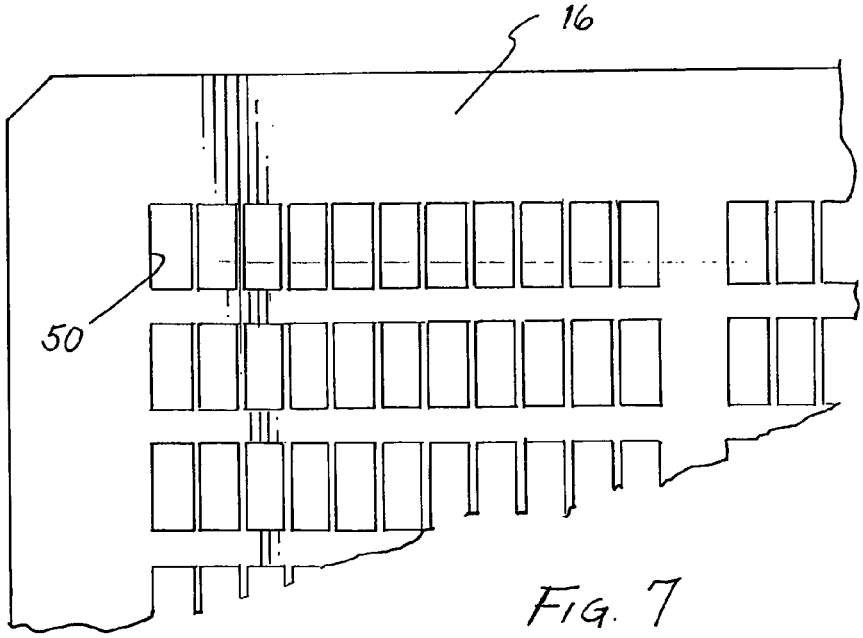
FIG. 7 is a partial view of a rodent screen embodied in the vent shown in FIG. 1.

As noted in FIG. 7, the corners of rodent screen 16 may be cut off. However, depending upon the configuration of frame 12, the corners may be left. Furthermore, it is to be understood that the perimeter of the rodent screen, as well as louvered panel 14, are configured to correspond with the configuration of frame 12.

It is to be understood that the rodent screen and the louvered panel may be retained in place and adjacent one another by the compression exerted by fascia 18 and backing 20. Alternatively, the louvered panel and rodent screen may be spot welded to one another or toggle locks 64, as illustrated in FIG. 7*b*, may be used to produce a unitary structure to be fitted within a supporting frame.

Figure 8:
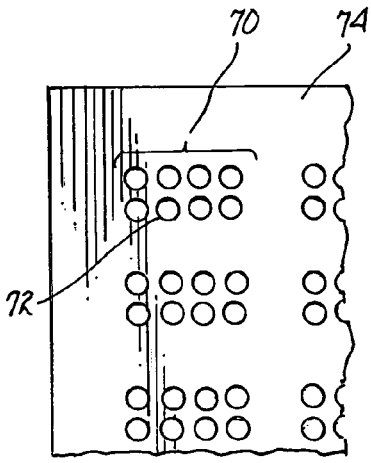
FIGS. 8 through 13 illustrate variants of a rodent screen.
Figure 9:
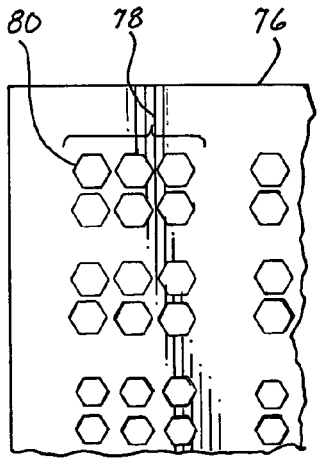
Figure 10:
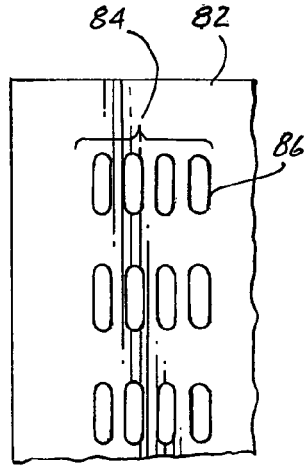
Figure 11:
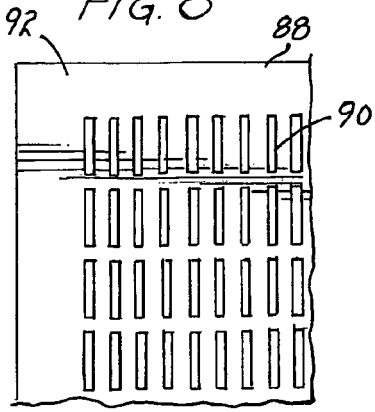
Figure 12:
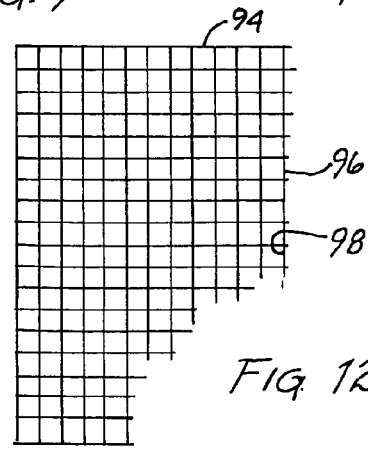

FIGS. 8 through 12 illustrate variants of the apertures that may be formed in a rodent screen. In particular, FIG. 8 shows groups 70 of circular apertures 72 formed rodent screen 74 and located to be generally juxtaposed with corresponding louvers in an adjacent louvered panel. FIG. 9 illustrates a rodent screen 76 having groups 78 of hexagonal apertures 80. These groups of apertures would be located in rodent screen 76 in juxtaposed relationship with the louvers of an adjacent louvered panel. Rodent screen 82 in FIG. 10 illustrates groups 84 of oblong apertures 86 conforming in size with code requirements. These groups of apertures would become juxtaposed with corresponding louvers of an adjacent louvered panel. FIG. 11 illustrates a rodent screen 88 having a plurality of elongated apertures 90 disposed within a solid border 92. These apertures would extend along rodent screen 88 and not grouped in the manner apertures 50 are grouped in rodent screen 16, as shown in FIG. 7. FIG. 12 illustrates a rodent screen 94 formed of a wire mesh 96. The wire mesh is configured to provide apertures 98 having a dimension of no less than one quarter inch as the smallest dimension and the largest dimension is configured no greater than one half inch. For illustrative purposes, wire mesh 96 is shown as defining a plurality of essentially square apertures.

Figure 13:
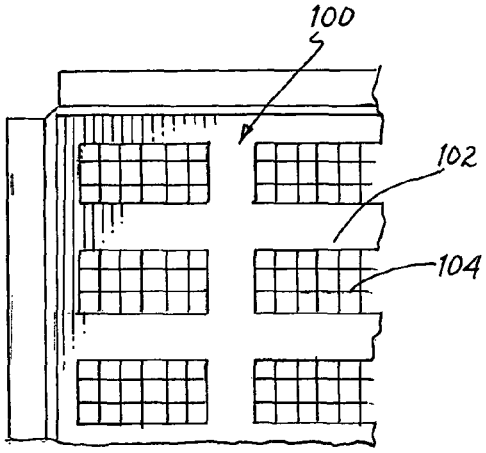

A variant rodent screen 100 is shown in FIG. 13. Herein the screen is formed of a sheet of metal with groups 102 of apertures 104. Using well known manufacturing processes, the groups of apertures are punched to provide apertures having the smallest dimension at least one quarter inch and the largest dimension no less than one half inch. For illustrative purposes, these apertures are shown as being essentially square.

Figure 14:
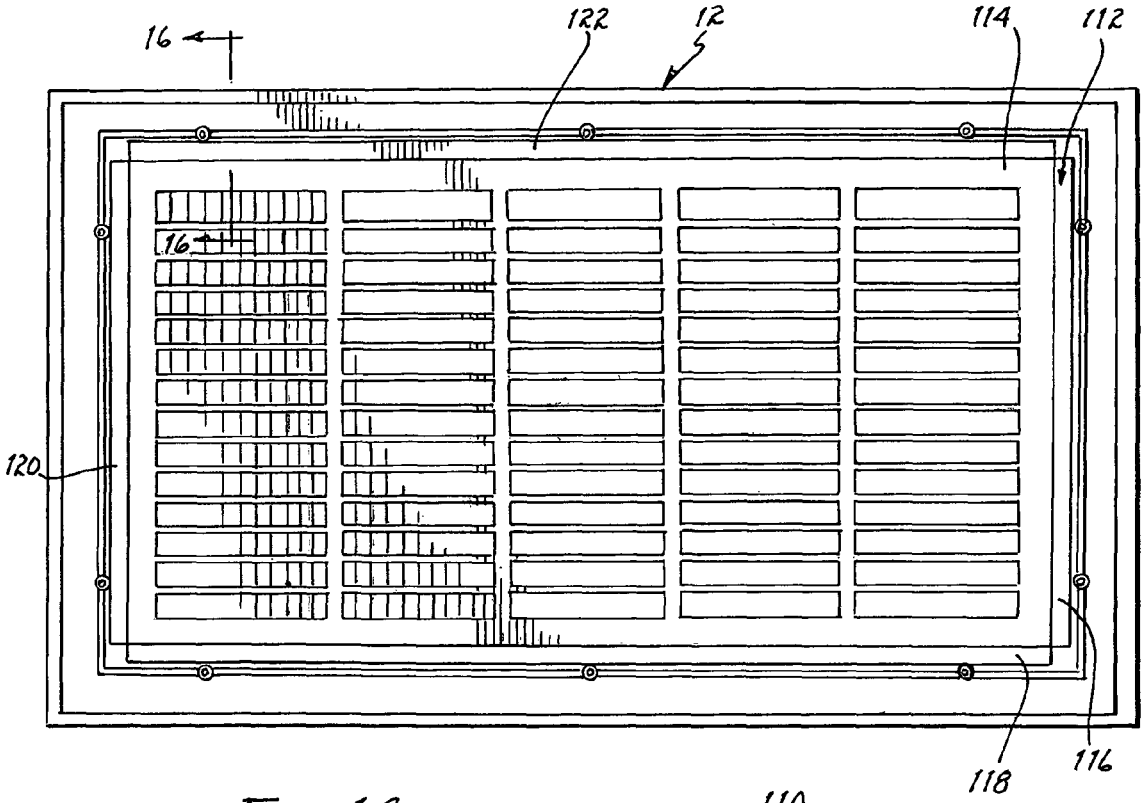
FIG. 14 illustrates a variant of the vent shown in FIG. 1.
Figure 15:
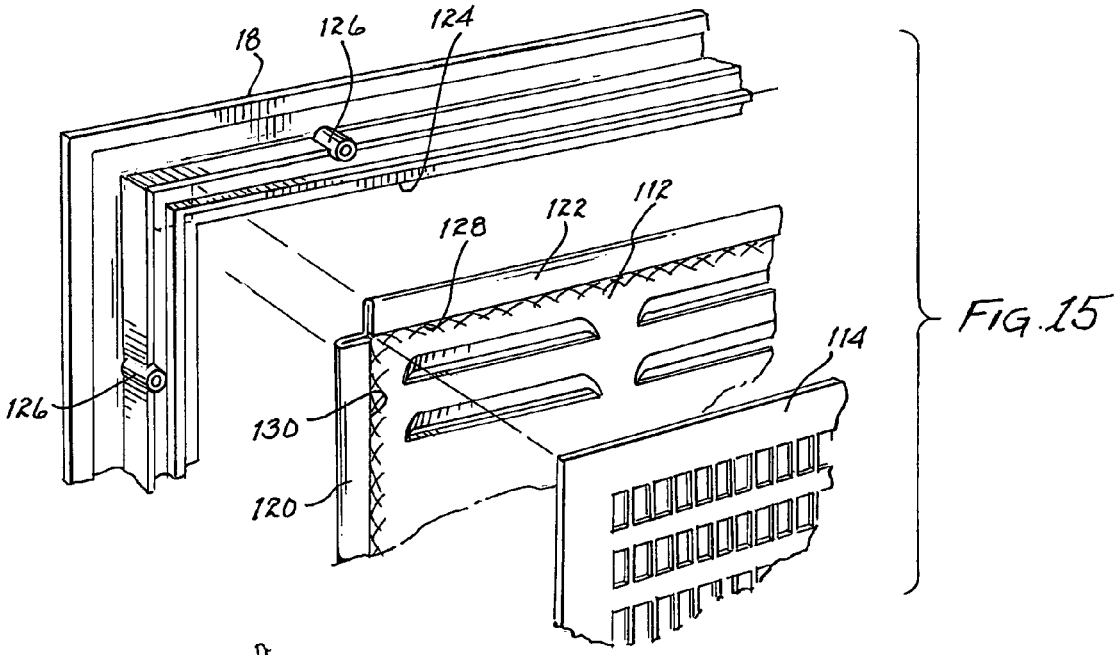
FIG. 15 illustrates a partial exploded view of the variant shown in FIG. 14.
Figure 16:
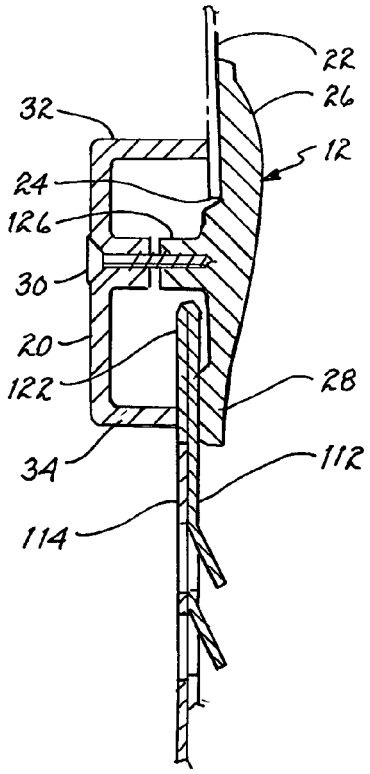
FIG. 16 is a partial cross-sectional view of a two part frame, louvered panel and rodent screen embodied in the variant shown in FIG. 14.

Referring to FIGS. 14, 15 and 16 there is illustrated a variant vent 110 of a flood and combustion air vent. This variant vent is quite similar to vent 10 in many respects and only the variations therebetween will be described in detail.

Frame 12 is commercially available and mountable in a panel 22 of a garage door. Quite often it is used as a mounting for a sheet of light transmissive glass to help light the interior of a garage. This sheet of glass normally has a thickness of approximately 0.100 inches. The dimensions of fascia 18 and backing 20 are configured to snuggly grip the sheet of glass therebetween. As particularly shown in FIG. 16, the combination of louvered panel 112 and rodent screen 114 are of thicknesses, when combined, of approximately 0.100 inches. Thereby, upon attachment of backing 20 to fascia 18 the louvered panel and rodent screen will be firmly gripped.

Louvered panel 112 has bent over edges 116, 118, 120 and 122, as particularly illustrated in FIG. 16. The ends of these edges define a wall serving in the manner of a jig to position rodent screen 114 therewithin. The rodent screen is welded, toggle locked or adhesively attached to louvered panel 112. It may be noted that sometimes the bent over edges are referred to as 'hemmed edges.'

As shown in FIGS. 14 and 15, louvered panel 112 extends laterally outwardly from interior edge 124 of frame 12. It may extend to a location proximate boss 126 extending from fascia 18. Thereby, relative movement between the louvered panel and fascia 18 is relatively limited, if any. Rodent screen 114, which may be any of the type described previously, is dimensioned to nest within the walls defined by the bent over edges, such as wall 128 attendant bent over edge 122, and wall 130 attendant bent over edge 120.

Figure 17A:
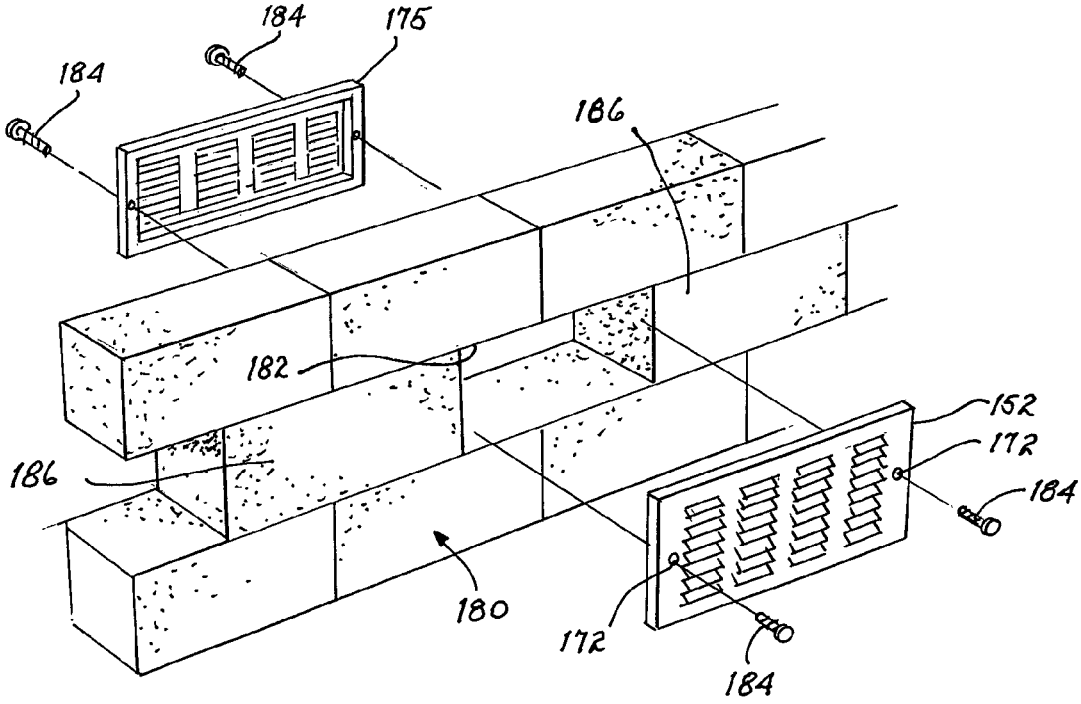
FIG. 17*a* illustrates a flood and combustion air vent used as a retrofit for an existing opening in a block wall.
Figure 17:
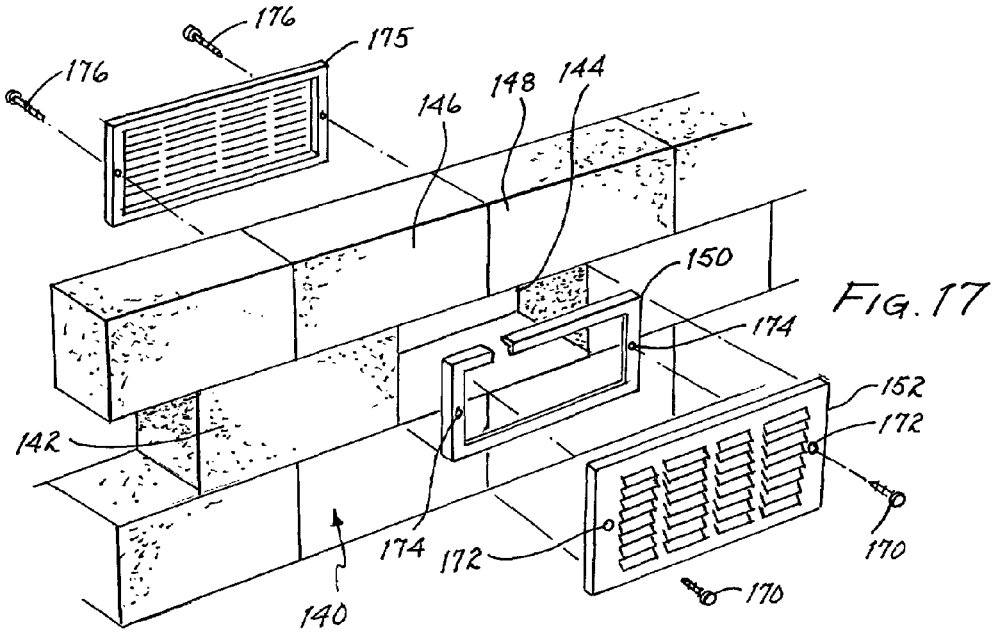
FIG. 17 illustrates a flood and combustion air vent mountable in a block wall wherein a block has been removed to create an opening.
Figure 18:
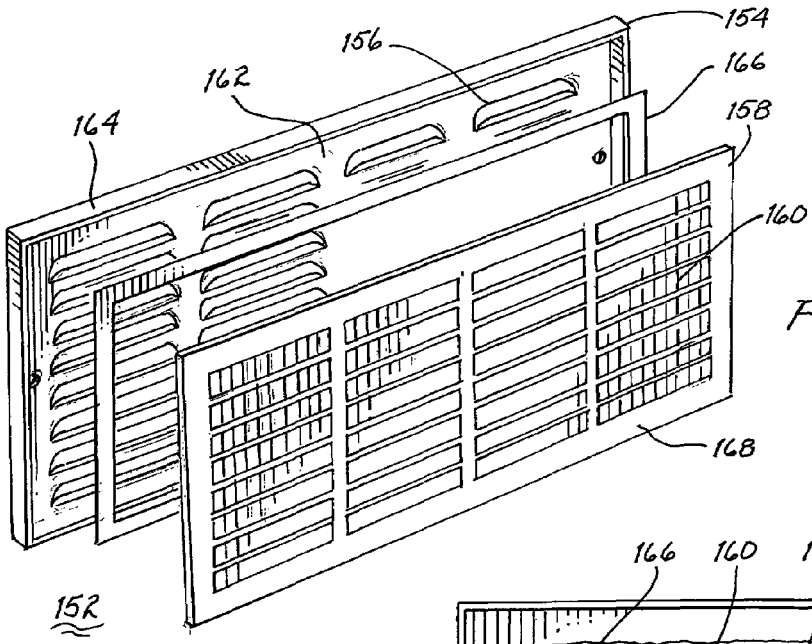
FIG. 18 is an exploded rear view of the vent shown in FIGS. 17 and 17*a;*
Figure 19:
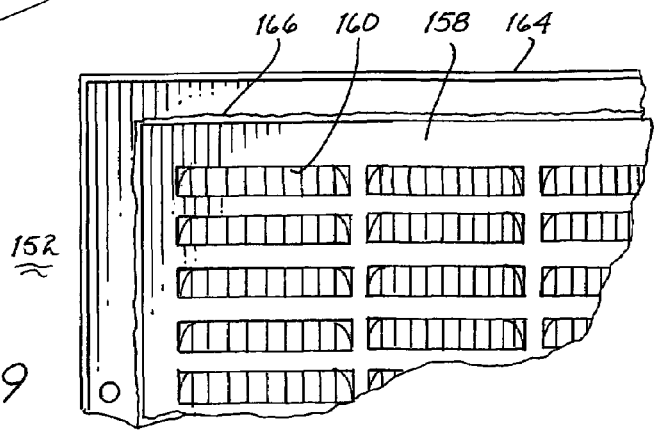
FIG. 19 is a partial rear view of the vent shown in FIG. 18.

Referring to FIGS. 17, 17*a*, 18 and 19, there is illustrated a flood vent and a combustion air vent for use in a block wall, either as part of new construction or as a retrofit. Referring particularly to FIG. 17, there is illustrated a conventional block wall 140 formed of several courses of blocks 142. To provide for water inflow or outflow from an enclosure defined by the block wall and to provide for ventilation, a block has been removed, as depicted by a void or opening 144. To ensure that blocks 146, 148 above the opening will not have a tendency to migrate downwardly into opening 144, a rectangular brace 150 may be inserted at the front and back of the opening. This brace would provide support for the overlying blocks and prevent splitting or other damage to block wall 140 due to migration of blocks 146, 148 and any further overlying blocks. A flood vent 152, as particularly illustrated in FIGS. 18 and 19, includes a louvered panel 154 having a plurality of louvers 156 which comply with code requirements for flood vents. A rodent screen 158 having a plurality of apertures 160, as described above, is mounted adjacent interior surface 162 of louvered panel 154 and within lip 164 extending about the louvered panel. To retain rodent screen 158 in place, strips of double sided adhesive tape 166 are placed adjacent the interior surface of border 168 of the rodent screen and in corresponding locations on interior surface 162 surrounding louvers 156 of the louvered panel. Alternatively the rodent screen may be toggle locked or welded to louvered panel 154.

Flood vent 152 is retained in place adjacent opening 144 by screws 170 penetrably engaging holes 172 in louvered panel 154 and threadedly engaging corresponding holes 174 in brace 150. Thereby, flood vent 152 accommodates a flow of flood water into and out of the enclosure defined by block wall 140. For esthetic or other purposes, a further louvered panel 175 may be mounted on the other side of opening 144. It may be attached to a second brace (not shown) disposed in opening 144, adjacent the interior side of the block wall. Screws 176 may be used to secure louvered panel 175 in place. As rodent screen 158 will prevent intrusion of rodents and vermin, there is no need to mount a similar rodent screen within louvered panel 175.

It is to be noted that flood vent 152 and louvered panel 175 are also capable of serving the requirements of a combustion air vent should the need for such ventilation exist or arise.

Referring to FIG. 17*a* there is shown a variant mounting for flood vent 152. It is presumed that block wall 180 is an existing wall having an opening 182 formed therein during construction of the block wall. Although not shown, it is presumed that a lintel extends across the top of the opening to support the overlying blocks. Flood vent 152 is constructed in the manner described above with respect to the flood vent 152 illustrated in FIGS. 18 and 19. Flood vent 152 is attached to block wall 180 by screws 184, or the like, penetrably engaging holes 172 and in to threaded engagement with respective ones of blocks 186. Such attachment may be accomplished by using screws, or the like particularly adapted for threadedly engaging a concrete block. Alternatively, a hole may be drilled in each block to receive an insert. Screws 184, bolts, or the like, would engage such insert(s). The rear of opening 182 may be covered by a conventional louvered panel 175, as described above and assuming that the corresponding side of the block wall is an interior surface. Louvered panel 175 would be attached to the block wall, in the manner of flood vent 152 by screws 184 or the like.

As described above, flood vent 152 shown in FIG. 17*a* satisfies all of the criteria for a flood vent and a combustion air vent, as set forth in national and international codes. Thus, ingress and egress of water through opening 182 would comply with flood water and air flow requirements.

At some locations, concrete blocks may be oriented vertically (rather than horizontally as illustrated in 17 and 17*a*) for walls or pillars. Referring jointly to FIGS. 20, 21, 22, 23, 24 and 25 there is shown a further variant of a flood and combustion air vent mounted in a concrete block structure 192 wherein the concrete blocks are oriented vertically with the openings therein facing the interior and exterior sides of the wall. Such orientation of the concrete blocks is particularly illustrated in FIG. 21 wherein block 194 is shown. Vent 190 includes a louvered panel 196 having a circumscribing lip 198. A rodent screen 200 is attached to the inside surface of louvered panel 196 by toggle locks, welds or the like, as represented by dots identified by numeral 202. It is to be understood that double sticky-back tape may also be used as such tape is presently commercially available that has sufficient structural integrity to serve the purpose of retaining the rodent screen in place despite a flow of water therethrough or other disturbing forces. Rodent screen 200 includes a plurality of apertures 204 conforming in size to various national and international codes. That is, each of these apertures has one dimension of not less than one quarter inch and a second dimension of not more than a half inch. While rectangular shaped apertures are illustrated, it is to be understood that differently shaped apertures may be employed, as discussed above with respect to FIG. 8 and other figures.

Figure 20:
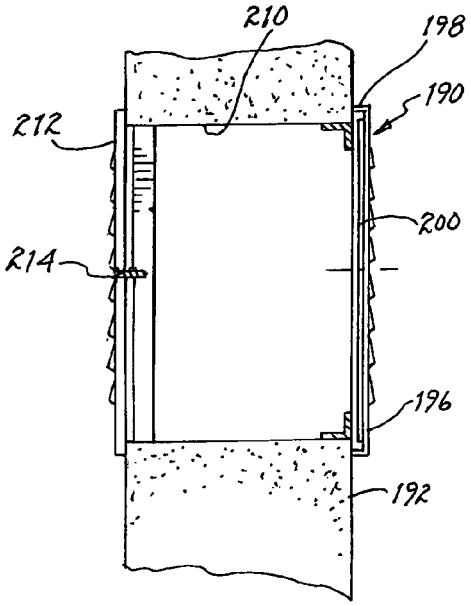
FIG. 20 is a cross-sectional of a vertically oriented opening formed in a block wall and showing a flood and combustion air vent extending thereacross.
Figure 24:
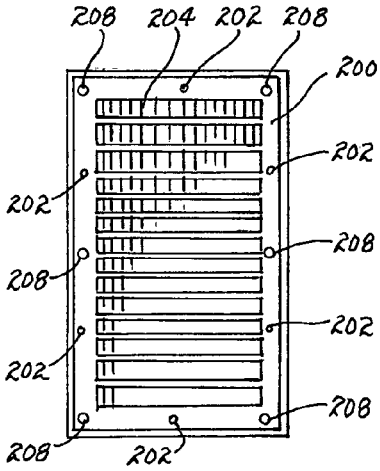
FIG. 24 is a rear view of the flood and combustion air vent usable in the embodiment illustrated in either of FIG. 20 or 22.
Figure 25:
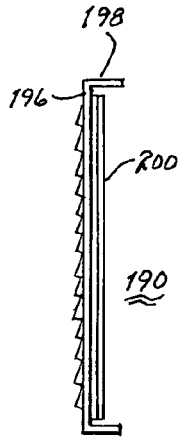
FIG. 25 is a cross-sectional view of the flood and combustion air vent.
Figure 21:
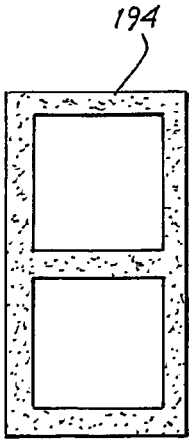
FIG. 21 illustrates a representative concrete block vertically oriented prior to covering the openings therein with a flood and combustion air vent.
Figure 22:
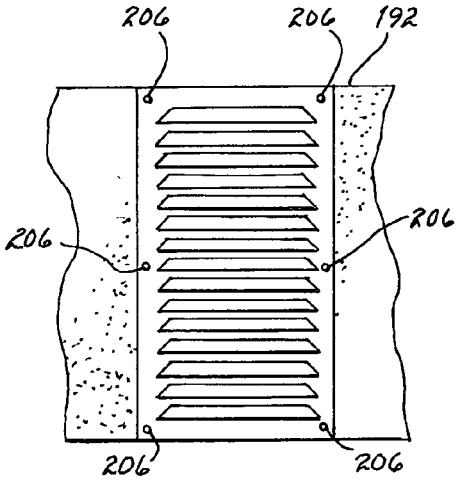
FIG. 22 illustrates the flood and combustion air vent mounted on the block illustrated in FIG. 21.

As particularly illustrated in FIGS. 20 and 24, vent 190 may be secured to concrete wall or a column or other such structure 192 by attachment means, such as concrete nails. Alternatively, holes may be drilled in the underlying structure to receive inserts for engagement by screws/bolts or other attachment means extending through apertures 208 in the louvered panel and the rodent screen.

It is expected that vent 190 is mounted on the exterior of structure 192 and generally coincident with opening 210 extending therethrough. The other side of the opening may include a co be employed.

Figure 23:
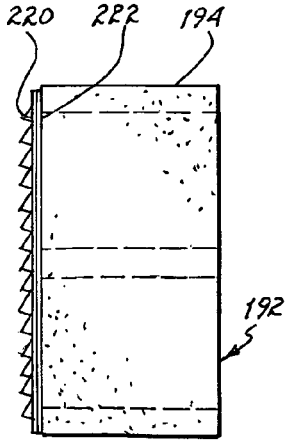
FIG. 23 is a partial cross-sectional view of the flood and combustion air vent attached to a vertically oriented concrete block.

As particularly shown in FIG. 23, it is not necessary for a louvered panel 220 to include a lip for circumscribing rodent screen 222. The rodent screen may be attached by toggle locks, welding or double sticky adhesive tape to the interior surface of the louvered panel. In turn, the louvered panel is attached to structure 192, such as block 194, by attachment means well known to those skilled in the art. Thereby, not only is the rodent screen mechanically attached to the louvered panel, but it will be compressed between concrete block 194 and the louvered panel to prevent movement. Alternatively, the attachment means for attaching the louvered panel to structure 192 may extend through holes in rodent screen 222. Thereby, there is a mechanical attachment of the rodent screen to the concrete block and the rodent screen is immovably located between the louvered panel and structure 192.

I claim:

1. A combination of a flood and combustion air vent and a garage door, said combination comprising:

a) a louvered panel having an exterior surface and in interior surface;

b) a rodent screen having a plurality of apertures and located adjacent the interior surface of said louvered panel;

c) a frame for attaching said louvered panel and said rodent screen across an opening in a panel of said garage door, said frame including a fascia extending about the opening in said garage door panel and adapted to be in contact with the exterior surface of said garage door panel surrounding the opening and in contact with the peripheral exterior surface of said louvered panel and a backing for bearing against the interior surface of said garage door panel generally coincident with said fascia and for bearing against said rodent screen to urge said rodent screen adjacent the interior surface of said louvered panel; and d) means for securing said backing to said fascia.

2. The combination as set forth in claim 1 whereas each aperture of said plurality of apertures in said rodent screen has a first dimension of at least one quarter inch and a second dimension of no more than one half inch.

3. The combination as set forth in claim 1 where said rodent screen is of a sheet of metal.

4. The combination as set forth in claim 1 wherein said plurality of apertures comprise groups of apertures.

5. The combination as set forth in claim 4 wherein each aperture of said groups of apertures has a first dimension of at least one quarter inch and a second dimension of no more than one half inch.

6. The combination as set forth in claim 1 wherein said louvered panel and said rodent screen are of metal and including at least one weld for securing said louvered panel with said rodent screen.

7. The combination as set forth in claim 1 wherein said louvered panel and said rodent screen are of metal and including at least one toggle lock for securing said louvered panel with said rodent screen.

8. The combination as set forth in claim 1 wherein said louvered panel includes bent over edges defining a wall and wherein said rodent screen is dimensional to nest within and adjacent said wall.

9. The combination as set forth in claim 1 including double stick tape located intermediate said louvered panel and said rodent screen.

10. The combination as set forth in claim 1 wherein the opening defined by each louver of said louvered panel has a dimension of not less than one quarter inch.

11. A combination of a flood and combustion air vent and a block wall having an opening in said block wall, said combination comprising:

a) a louvered panel having an interior surface and an exterior surface and a peripheral wall;

b) a rodent screen disposed adjacent the interior surface of said louvered panel and within the dimensions of said peripheral wall, said rodent screen including a plurality of apertures, each aperture of said plurality of apertures having one dimension of no less than one quarter inch and a second dimension of no more than one half inch;

c) means for retaining said rodent screen adjacent said louvered panel;

d) a brace disposed within the opening in said block wall; and e) attachment means for securing said louvered panel and said rodent screen with said brace to locate said louvered panel and said rodent screen across and covering the opening in said block wall.

12. The combination as set forth in claim 11 wherein said louvered panel is of a rectangular configuration having a longitudinal axis and a lateral axis and wherein the louvers of said louvered panel are aligned with the longitudinal axis.

13. The combination as set forth in claim 11 wherein said louvered panel is of a rectangular configuration having a longitudinal axis and a lateral axis and wherein the louvers of said louvered panel are aligned with the lateral axis.

14. A method for accommodating a flow of flood water into and out of an opening in an enclosure in a building while preventing intrusion of rodents, vermin and reptiles, said method comprising the steps of:

a) attaching with screws a louvered panel having a lipped perimeter to the enclosure about the opening and across the opening;

b) prior to exercise said steps of attaching, placing a rodent screen adjacent the interior surface of the louvered panel within the lipped perimeter of the louvered panel to extend across and cover the opening, the rodent screen including a plurality of apertures, each of the apertures having a first dimension of not less than one quarter inch and a second dimension of not more than one half inch; and c) retaining the rodent screen adjacent the louvered panel to restrain the force of flood water from dislodging the rodent screen from a location adjacent the louvered panel.

15. The method as set forth in claim 14 wherein the step of retaining comprises the step of welding the rodent screen with the louvered panel.

16. The method as set forth in claim 14 wherein the step of retaining comprises the step of securing the rodent screen to the louvered panel with toggle locks.

17. The method as set forth in claim 14 including the step of placing a brace within the opening and the step of securing the louvered panel and the rodent screen to the brace.

* * * * *